US011566874B2

(12) United States Patent
Zekanovic et al.

(10) Patent No.: US 11,566,874 B2
(45) Date of Patent: Jan. 31, 2023

(54) EXPANDABLE BUMPER FOR AN ELECTRODE

(71) Applicant: Axon Enterprise, Inc., Scottsdale, AZ (US)

(72) Inventors: Dubravko Zekanovic, Scottsdale, AZ (US); Oleg Nemtyshkin, Scottsdale, AZ (US)

(73) Assignee: Axon Enterprise, Inc., Scottsdale, AZ (US)

( * ) Notice: Subject to any disclaimer, the term of this patent is extended or adjusted under 35 U.S.C. 154(b) by 0 days.

(21) Appl. No.: 17/458,041

(22) Filed: Aug. 26, 2021

(65) Prior Publication Data

US 2022/0196371 A1 Jun. 23, 2022

Related U.S. Application Data

(60) Provisional application No. 63/071,928, filed on Aug. 28, 2020.

(51) Int. Cl.
*F41H 13/00* (2006.01)

(52) U.S. Cl.
CPC ..... *F41H 13/0025* (2013.01)

(58) Field of Classification Search
CPC ..... F41H 13/0025; F41H 13/0018
USPC ..... 42/1.08; 361/232
See application file for complete search history.

(56) References Cited

U.S. PATENT DOCUMENTS

| | | | |
|---|---|---|---|
| 8,353,091 | B2 | 1/2013 | Linker |
| 8,587,918 | B2 | 11/2013 | Hanchett et al. |
| 10,024,636 | B2 | 7/2018 | Nerheim |

(Continued)

FOREIGN PATENT DOCUMENTS

| | | | |
|---|---|---|---|
| CN | 207163336 | U | 3/2018 |
| EP | 1671406 | B1 | 10/2007 |

(Continued)

OTHER PUBLICATIONS

Korean Intellectual Property Office, International Search Report for International Application No. PCT/US2021/047811 dated Dec. 6, 2021.

(Continued)

*Primary Examiner* — Reginald S Tillman, Jr.
(74) *Attorney, Agent, or Firm* — Andrew Terajewicz; Justin Powley

(57) ABSTRACT

A bumper for preventing a forward portion of an electrode from penetrating a target comprises a rearward portion and an expandable portion. The rearward portion is configured to couple the bumper to a forward portion of an electrode. The expandable portion may comprise a plurality of members. The expandable portion is configured to transition from a collapsed state to an expanded state after being launched toward a target. The expanded state comprises a greater contact area than the contact area of the collapsed state. The greater contact area of the expanded state is configured to distribute a force of impact on the target to prevent penetration into the target. The transition from the collapsed state to the expanded state may be configured to increase a duration of impact with the target, thereby reducing a force of impact on the target to prevent penetration into the target.

20 Claims, 6 Drawing Sheets

(56) References Cited

U.S. PATENT DOCUMENTS

2014/0063679 A1* 3/2014 Park ..... F41H 13/0025
361/232

FOREIGN PATENT DOCUMENTS

WO 2006115854 A2 11/2006
WO WO-2012082012 A2 * 6/2012 ..... F41H 13/0025

OTHER PUBLICATIONS

Taiwan Patent Office, Taiwan IPO Search Report for Taiwan Application No. 110131879 completed May 25, 2022.

* cited by examiner

EXPANDABLE BUMPER FOR AN ELECTRODE

FIELD OF INVENTION

Embodiments of the present invention relate to expandable bumpers used with electrodes of electronic weaponry.

BRIEF DESCRIPTION OF THE SEVERAL VIEWS OF THE DRAWING

Embodiments of the present invention will be described with reference to the drawing, wherein like designations denote like elements, and.

DETAILED DESCRIPTION

Figure 1A:
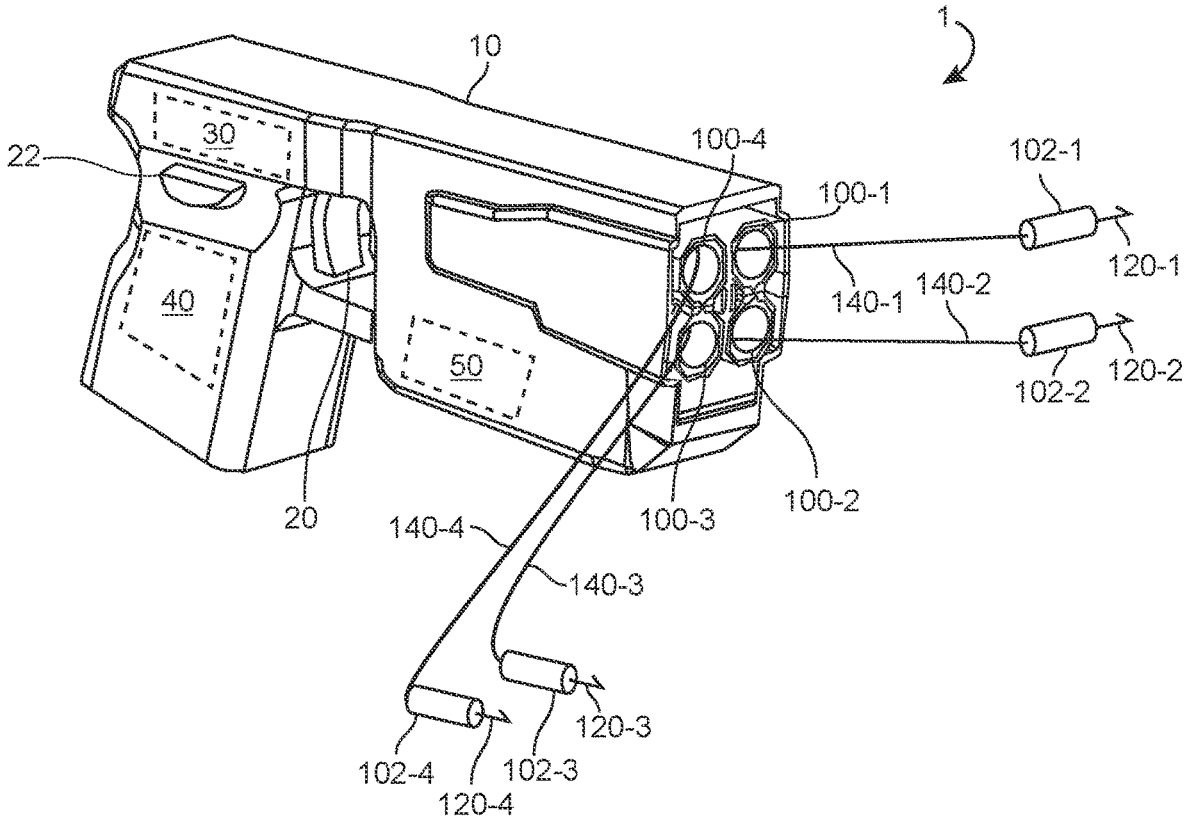
FIG. 1A is perspective diagram of an implementation of a conducted electrical weapon according to various aspects of the present disclosure.

The detailed description of exemplary embodiments herein refers to the accompanying drawings, which show exemplary embodiments by way of illustration. While these embodiments are described in sufficient detail to enable those skilled in the art to practice the disclosures, it should be understood that other embodiments may be realized and that logical changes and adaptations in design and construction may be made in accordance with this disclosure and the teachings herein. Thus, the detailed description herein is presented for purposes of illustration only and not of limitation.

The scope of the disclosure is defined by the appended claims and their legal equivalents rather than by merely the examples described. For example, the steps recited in any of the method or process descriptions may be executed in any order and are not necessarily limited to the order presented. Furthermore, any reference to singular includes plural embodiments, and any reference to more than one component or step may include a singular embodiment or step. Also, any reference to attached, fixed, coupled, connected, or the like may include permanent, removable, temporary, partial, full, and/or any other possible attachment option. Additionally, any reference to without contact (or similar phrases) may also include reduced contact or minimal contact.

Systems, methods, and apparatus are provided herein. In the detailed description herein, references to "various embodiments," "one embodiment," "an embodiment," "an example embodiment," etc., indicate that the embodiment described may include a particular feature, structure, or characteristic, but every embodiment may not necessarily include the particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art to affect such feature, structure, or characteristic in connection with other embodiments whether or not explicitly described. After reading the description, it will be apparent to one skilled in the relevant art(s) how to implement the disclosure in alternative embodiments.

A conducted electrical weapon ("CEW," e.g., conducted energy weapon, electronic weapon, electronic control device, etc.), according to various aspects of the present disclosure, may include a launch device and one or more cartridges removably coupled with the electronic weapon. Each cartridge may include expendable (e.g., single use) components (e.g., tether wires, electrodes, propulsion modules, etc.), and storage cavities (e.g., bores, chambers, etc.).

A tethered electrode is an assembly of a filament (e.g., cord, wire, tether, conductor, group of cords and/or conductors, etc.) and an electrode at least mechanically coupled to an end portion of the filament. A portion of the filament near the other end of the filament is at least mechanically coupled to the cartridge and/or the launch device (e.g., one end fixed within the cartridge), generally until the deployment unit is removed from the CEW. As discussed below, mechanical coupling of the cartridge and the CEW may facilitate electrical coupling of the launch device and the electrode prior to and/or during operation of the CEW.

A launch device of a CEW launches at least one tethered electrode of the CEW away from the cartridge and toward a target. As the electrode travels toward the target, the electrode deploys a length of filament from storage within the cartridge and/or electrode body. The filament trails the electrode. After launch, the filament spans (e.g., extends, bridges, stretches, etc.) a distance from the deployment unit to the electrode that is generally positioned in or near a target.

CEWs that use tethered electrodes, according to various aspects of the present disclosure, include hand-held devices, apparatus fixed to buildings or vehicles, and stand-alone stations. Hand-held devices may be used in law enforcement, for example, deployed by an officer to take custody of a target. Apparatus fixed to buildings or vehicles may be used at security checkpoints or borders, for example, to manually or automatically acquire, track, and/or deploy electrodes to stop intruders. Stand-alone stations may be set up for area denial, for example, as used by military operations.

An electrode (e.g., dart, probe, etc.), according to various aspects of the present disclosure, provides a mass for launching toward a target. The intrinsic mass of an electrode includes a mass that is sufficient to fly, under force provided by activation of a propulsion module, from a launch device to a target. The mass of the electrode includes a mass that is sufficient to deploy (e.g., pull, uncoil, unravel, draw) a filament from storage in the electrode and/or cartridge. The mass of the electrode is sufficient to deploy a filament behind the electrode while the electrode flies toward a target. The mass of the electrode deploys the filament from storage and behind the electrode in such a manner that the filament spans a distance between the launch device and the electrode positioned at a target.

In various embodiments, an electrode provides a surface for receiving a propelling force to propel the electrode away from a cartridge and toward a target. Movement of the electrode away from the cartridge is limited by aerodynamic drag and by a resistance force (e.g., tension in the filament) that resists deploying a filament from storage and pulling the filament behind the electrode in flight toward a target.

In various embodiments, a forward portion of an electrode may be oriented toward a target prior to launch. Upon launch and/or during flight from the cartridge and toward the target, the forward portion of the electrode may orient toward the target. An electrode may have an aerodynamic form for maintaining the forward portion of the electrode oriented toward a target. The aerodynamic form of an electrode may provide suitable accuracy for hitting the target.

In various embodiments, an electrode may include a shape for receiving a propelling force to propel the electrode toward a target. A shape of an electrode may correspond to a shape of a portion of the launch device or cartridge that provides a propelling force to propel the electrode. For example, a cylindrical electrode may be propelled from a cylindrical bore of a cartridge. During a launch of an electrode by expanding gas, the electrode may seal the tube to accomplish suitable acceleration and launch velocity. A rear face of the cylindrical electrode may receive substantially all of the propelling force.

In various embodiments, an electrode may include a substantially cylindrical overall shape. Prior to launch, such an electrode may be positioned in a substantially cylindrical tube slightly larger in diameter than the electrode. A propelling force (e.g., rapidly expanding gas) may be applied to a closed end of the tube. The force may push against a piston or the rear portion of the electrode to propel the electrode out of an open end of the tube toward a target.

In various embodiments, an electrode may include a shape and a surface area for aerodynamic flight for suitable accuracy of delivery of the electrode across a distance toward a target, for example from about 10 feet to 50 feet (3 meters to 15 meters) from a launch device to a target. An electrode may rotate in-flight to provide spin-stabilized flight. An electrode may maintain its pre-launch orientation toward a target during launch, flight, and impact with a target.

Upon impact, an electrode is configured to mechanically couple to a target. Mechanical coupling may include penetrating clothing, tissue, or clothing and tissue of a target; resisting removal from clothing, tissue, or clothing and tissue of a target; remaining in contact with a target surface (e.g., tissue, hair, clothing, armor, etc.); and/or resisting removal from the target surface. Coupling may be accomplished by piercing, lodging (e.g., hooking, grasping, entangling, adhering, gluing), and/or wrapping (e.g., encircling, covering). An electrode, according to various aspects of the present disclosure, may include one or more structures (e.g., hooks, barbs, spears, glue ampoules, tentacles, bolos, etc.) for mechanically coupling the electrode to a target. A structure for coupling may penetrate a protective barrier (e.g., clothing, hair, armor, etc.) on an outer surface of a target.

In various embodiments, an electrode may include an integral structure or separate part functioning as a spear (e.g., pointed shaft, needle, etc.). The spear is configured to penetrate one or more articles of wear (e.g., clothing, articles worn by a person, etc.) and/or tissue up to the length of the spear (e.g., up to a face of the electrode, up to a forward portion of the electrode, up to a bumper, etc.). Penetration may be arrested by friction (e.g., contact of the spear with target clothing or tissue), and/or abutment of a portion of the electrode and the target. A spear may extend away from a face of the electrode toward the target. The spear may extend away from a forward portion of the electrode toward the target. The spear may include one or more barbs for increasing the strength of the mechanical coupling of the electrode to the target. The barbs may be arranged to accomplish suitable mechanical coupling at various lengths of penetration of clothing and/or tissue.

In various embodiments, an electrode may be mechanically coupled to a filament to deploy the filament from storage and to extend the filament from the launch device to the target. Mechanical coupling may include coupling a filament and an electrode with enough strength to retain the coupling during manufacture, prior to launch, during launch, after launch, during mechanical coupling of the electrode to a target, and while delivering a stimulus signal to a target. Mechanical coupling may be accomplished by confining the filament between surfaces of an electrode and/or confining the filament within a portion of the electrode (e.g., establishing a suitable stiction between a portion of the filament and one or more surfaces of an electrode). Confining may include enclosing, holding, retaining, maintaining mechanical coupling, and/or resisting separation. Confining may be accomplished by preventing or resisting movement or deformation (e.g., stretching, twisting, bending) of the filament. As discussed below, placing the filament in an interior and affixing a spear over the interior in one implementation confines the filament to the interior.

In various embodiments, an electrode may include a bumper (e.g., flower, basket, cushion, etc.). A bumper may be an integral structure or separate part of the electrode. A bumper may be disposed adjacent a face of an electrode. A bumper may be disposed adjacent a forward portion of an electrode. A bumper may overlap a portion of a spear. A bumper may be disposed at an end of a spear opposite a tip of the spear. A bumper may be configured to reduce shock provided by an impact (e.g., collision) of the electrode and the target. The bumper may be configured to minimize blunt impact and/or penetration of the forward portion of the electrode with the target by distributing the impact force (e.g., force of impact, etc.) of the electrode over a greater impact area (e.g., area of impact, contact area, surface contact area, etc.), distributing the impact force of the electrode over a longer duration (e.g., increasing a duration of impact, etc.), and/or absorbing kinetic energy of the electrode. The bumper may extend away from a face of the electrode and toward the target. The bumper may be arranged circumferentially about a spear of an electrode. The bumper may comprise an expandable portion. After a length of a spear penetrates a target, the expandable portion of the bumper may impact the target and expand (e.g., change shape, deform, etc.) to increase a contact area of the electrode with the target. Expansion of the expandable portion of a bumper may absorb kinetic energy of an impact of an electrode with a target. In other embodiments, deployment of the electrode from the cartridge may cause the expandable portion of the bumper to expand to increase the contact area of the electrode with the target prior to impact. An increase in contact area of an electrode with a target may reduce an impact pressure exerted by the electrode on the target. A bumper may reduce a likelihood of blunt impact and/or penetration of a body of an electrode with a target, thereby enabling an electrode to be launched from a launch device and impact a target with greater kinetic energy than an electrode without a bumper. For example, an electrode comprising a bumper may impact a target with 12 joules of energy without risk of the forward portion of the electrode penetrating the target, whereas an electrode without a bumper may only impact a target with 6 joules of energy without risk of the forward portion of the electrode penetrating the target.

An electrode facilitates electrical coupling of the launch device and the target. Electrical coupling generally includes a region or volume of target tissue associated with the electrode (e.g., a respective region for each electrode when more than one electrode is used).

For each electrode, electrical coupling may include placing the electrode in contact with target tissue (e.g., touching, inserting) and/or ionizing air in one or more gaps between the launch device, the deployment unit, the filament, the electrode, and target tissue. For example, a placement of an electrode with respect to a target that results in a gap of air between the electrode and the target does not electrically couple the electrode to the target until ionization of the air in the gap. Ionization may be accomplished by a stimulus signal that includes, at least initially, a relatively high voltage (e.g., about 25,000 volts for one or more gaps having a total length of about one inch). After initial ionization, the electrode remains electrically coupled to the target while the stimulus signal supplies sufficient current and/or voltage to maintain ionization. Ionization may not be needed, for instance when contact is accomplished by direct conduction from a spear to the tissue of the target.

An electrode for use with a deployment unit and/or an electronic weapon, according to various aspects of the present disclosure, performs the functions discussed above. For example, any of electrodes 102, 460, 560*a/b*, and 660*a/b* of FIGS. 1A-2B, 4A, and 5A-6B may be launched from launch device 10 toward a target to establish a circuit with the target to provide a stimulus signal through the target.

Electronic weapon 1 of FIG. 1A includes launch device 10 and one or more cartridges 100 (e.g., first cartridge 100-1, second cartridge 100-2, third cartridge 100-3, fourth cartridge 100-4, etc.). Launch device 10 includes user controls 20/22, processing circuit 30, power supply 40, and signal generator 50. In one implementation, launch device 10 comprises a housing. The housing may include a mechanical and electrical interface for each of cartridges 100. Various electronic circuits, processing circuit programming, propulsion technologies, and mechanical technologies may be used, suitably modified, and/or supplemented as discussed herein.

In various embodiments, a user control is operated by a user to initiate an operation of the weapon. User controls 20/22 may include a trigger, a manual safety, and/or a touch screen user interface operated by a user. When user controls 20/22 are packaged separately from launch device 10, various wired or wireless communication technology may be used to link user controls 20/22 with processing circuit 30.

In various embodiments, a processing circuit controls many, if not all, of the functions of an electronic weapon. A processing circuit may initiate a launch of one or more electrodes responsive to a user control. A processing circuit may control an operation of a signal generator to provide a stimulus signal. For example, processing circuit 30 receives a signal from user controls 20/22 indicating user operation of the weapon to launch an electrode and provide a stimulus signal. Processing circuit 30 provides a launch signal to one or more cartridges 100 to initiate launch of one or more electrodes 102 (e.g., first electrode 102-1, second electrode 102-2, third electrode 102-3, fourth electrode 102-4, etc.). Processing circuit 30 may provide a signal to signal generator 50 to provide the stimulus signal to the launched electrodes. Processing circuit 30 may include a microprocessor and memory that executes instructions (e.g., processor programming) stored in memory.

In various embodiments, a power supply provides energy to operate an electronic weapon and to provide a stimulus signal. For example, power supply 40 provides energy (e.g., current, pulses of current, etc.) to signal generator 50 to provide a stimulus signal. Power supply 40 may further provide power to operate processing circuit 30 and user controls 20/22. For handheld electronic weapons, a power supply may include a removable, replaceable, and/or rechargeable, such as a battery.

In various embodiments, a signal generator provides a stimulus signal for delivery through a target. A signal generator may reform energy provided by a power supply to provide a stimulus signal having suitable characteristics (e.g., ionizing voltage, charge delivery voltage, charge per pulse of current, current pulse repetition rate) to interfere with target locomotion. A signal generator electrically couples to a filament to provide the stimulus signal through the target as discussed above. For example, signal generator 50 provides a stimulus signal to tethered electrodes 102 of deployment unit 10 via their respective filaments 140 (e.g., first filament 140-1, second filament 140-2, third filament 140-3, fourth filament 140-4, etc.). Signal generator 50 is electrically coupled via an interface to cartridges 100, which are in turn electrically coupled to filaments 140. The stimulus signal may comprise or consist of from 5 to 40 pulses per second, each pulse capable of ionizing air, each pulse delivering after ionization (if needed) about 80 microcoulombs of charge to a human or animal target.

In various embodiments, a cartridge (e.g., unitary cartridge, etc.) receives a launch signal from a launch device to initiate a launch of one or more electrodes and a stimulus signal to deliver through a target. A spent cartridge may be replaced with an unused cartridge after some or all electrodes of the spent cartridge have been launched. An unused cartridge may be coupled to the launch device to enable additional electrodes to be launched. A cartridge may receive, via an interface, signals from a launch device to perform the functions of a deployment unit.

Figure 1B:
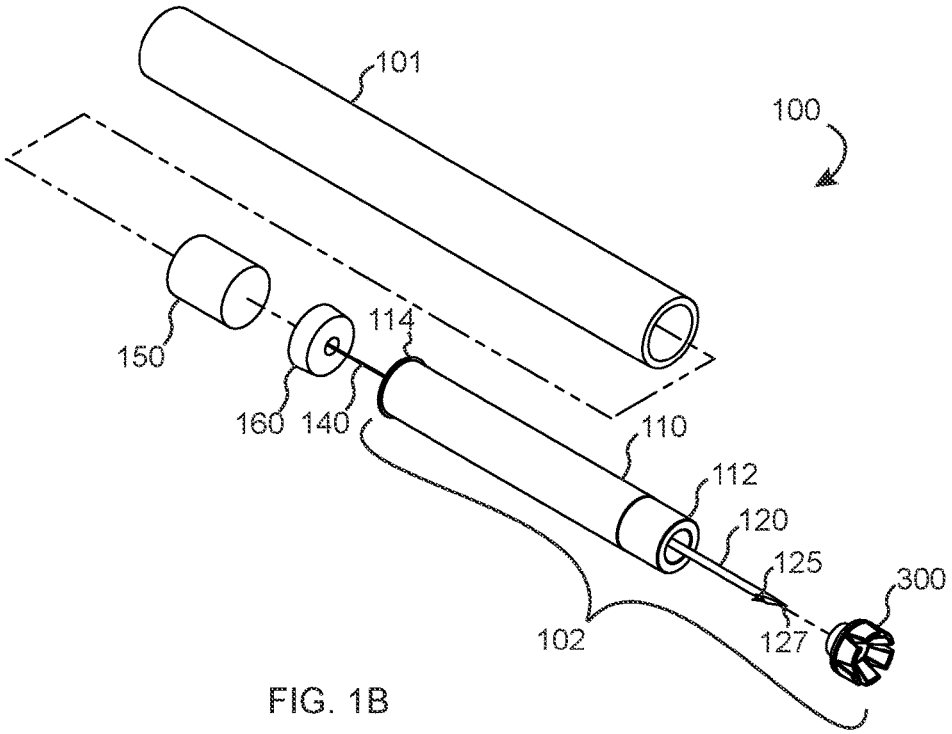
FIG. 1B is an exploded view of an implementation of a cartridge for a conducted electrical weapon according to various aspects of the present disclosure.
Figure 2A:
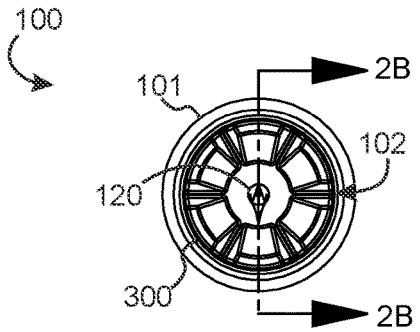
FIG. 2A is a front view of an implementation of a cartridge, according to various aspects of the present disclosure.
Figure 2B:
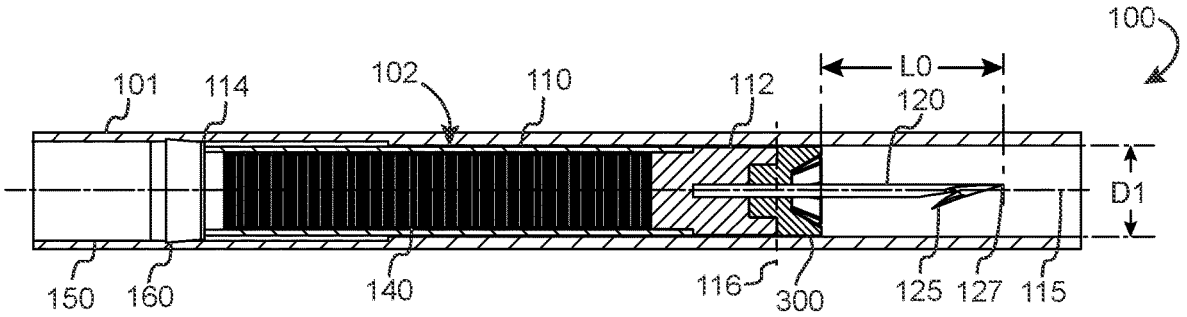
FIG. 2B is a cross section view of the cartridge of FIG. 2A along plane 2B-2B, according to various aspects of the present disclosure.

FIGS. 1B, 2A, and 2B show various views of a cartridge 100, in accordance with various embodiments. Cartridge 100 may include a cartridge body 101, an electrode 102, a propulsion module 150, and a piston 160.

In various embodiments, cartridge body 101 may include a shape for launching electrode 102 on a trajectory (e.g., path, flight, etc.). For example, cartridge body 101 may include a cylindrical shape that corresponds with a cylindrical shape of electrode 102. Cartridge body 101 may comprise a bore having an exit diameter D1. Exit diameter D1 may be equal to or greater than a diameter of electrode 102. During a launch of an electrode by expanding gas, electrode 102 may seal the bore of cartridge body 101 to accomplish suitable acceleration and launch velocity. Exit diameter D1 may be less than a maximum diameter of bumper 300, such as maximum diameter D3, to seal the bore of cartridge body 101.

Cartridge body 101 may store filament 140 and/or electrode 102 may store filament 140. Filament 140 mechanically and electrically couples electrode 102 as discussed herein. Processing circuit 30 initiates activation of propulsion module 150 via a launch signal. Activation of propulsion module 150 may provide a propelling force on piston 160. Piston 160 may provide the propelling force on electrode 102 to cause electrode 102 to launch from cartridge body 101 toward a target. For example, activation of propulsion module 150 may create a propelling force (e.g., rapidly expanding gas) that is applied to a closed end of cartridge body 101. The propelling force may push against piston 160, or the rear surface of electrode 102, to propel electrode 102 out of an open end of cartridge body 101 toward a target.

In embodiments, electrode 102 is coupled to deploy a respective filament from storage. As electrode 102 flies toward a target, electrode 102 may deploy its respective filament 140 out from its storage. Signal generator 50 provides the stimulus signal through the target via the filaments coupled to electrode 102.

An electrode, according to various aspects of the present disclosure, may perform one or more of the following functions in any combination: binding the filament to the electrode, deploying the filament, mechanically coupling the electrode to a target, enabling conduction of the stimulus current from the filament through the target, spreading a current density with respect to a region of target tissue, and diffusing a current into a volume of target tissue. Enabling conduction may include ionizing, spreading, and/or diffusing. Enabling conduction, may include ionization along or through insulative and/or composite material of one or more portions of the electrode. Enabling conduction may include ionization along or through insulative and/or composite material external to the electrode. Insulative materials include any material or substance (e.g., gas, liquid, solid, aggregation, suspension, composite, alloy, mixture, etc.) that presents, at any time or times, a relatively high resistance to current of the stimulus signal. Composite materials include insulative materials combined with conductive particles, layers, or fibers.

An electrode may have mass, shape, and surfaces for being attached to a filament, for being propelled, and for deploying the filament to a target, as discussed above. Various mass, shape, and surfaces may be employed. For example, an electrode may have a substantially cylindrical shape, an interior with surfaces that abut and/or grip a filament, and external surfaces with suitable aerodynamic properties for efficient propulsion and accurate flight to a target. An electrode may employ conductive, resistive, composite and/or insulative material on an intended path of conduction or propagation of stimulus current. An electrode may employ resistive, insulative, and/or composite material to diminish stimulus current conduction on undesired paths. An electrode may be rigid. To avoid breaking on impact, an electrode may have portions designed to flex to absorb energy of impact and thereby reduce the risk of breakage. Various metal and/or plastic fabrication technologies may be used in the manufacture of an electrode as discussed herein. Plastics may be filled with other materials (e.g., conductive particles, fibers, layers, etc.) to form composite materials uniformly or in suitable portions of a part.

An electrode may have any size and shape for suitably binding a filament and deploying a filament (e.g., substantially spherical, substantially cylindrical, having an axis of symmetry in the direction of flight, bullet shaped, tear drop shaped, substantially conical, golf tee shaped, needle shaped, dart shaped, blow dart shaped, thumbtack shaped, etc.). In various embodiments, an electrode may be formed of conductive, resistive, insulative, and/or composite materials, as discussed above. If insulative, a body portion of an electrode (i.e., all structures except those functioning as a spear, target retainer, or tip) may comprise composite material and/or be coated with insulative material. An electrode may comprise a spear or a body and a spear.

In various embodiments, an electrode may comprise a body (e.g., electrode body, etc.) (i.e., all structures except those functioning as a spear). The body of the electrode may comprise a shape as discussed above. The body of the electrode may be adjacent a spear. A spear may extend from the body of the electrode. An electrode body may comprise a diameter equal to a diameter of a spear. A diameter of the electrode body may be less than a diameter of a bumper. A body may comprise a forward portion opposite a rearward portion. The rearward portion may comprise a surface configured to receive a propelling force. The forward portion may comprise a shape configured to couple with and/or abut a portion of a bumper. The forward portion may terminate in a face. A spear may extend from the forward portion.

A spear may perform mechanical coupling as discussed above. A spear may have any size and shape for suitably piercing material and/or tissue of a target, lodging in material and/or tissue of a target, and/or forming an ionized path from the tip of the spear to target tissue. In various implementations, a spear may be formed of conductive, resistive, insulative, and/or composite materials. A spear may extend from a forward portion of an electrode. A spear may terminate at one end at a tip. An end of a spear distal to a face of an electrode may comprise the tip.

A tip (e.g., point, cone, apex comprising acute angles between faces, end of a shaft of relatively small diameter) may operate to pierce an outer surface (e.g., layer, etc.) of a target and/or target tissue. A tip of a spear facilitates mechanical coupling by piercing and lodging. A tip when insulated may operate as a gap or switch interfering with current flow (e.g., blocking) until a threshold voltage breaks down the insulator and/or permits ionization near the tip followed by current flow through the tip. A tip may include one or more points front-facing toward the target.

A barb may operate to lodge (e.g., retain) an electrode in clothing, armor, and/or tissue of a target to retain a mechanical coupling between the barb and the target. A barb portion of a spear resists mechanical decoupling (e.g., separation or removal from the target). A spear may include a barb. A spear may include a plurality of barbs arranged along a length of the spear. A barb may include a continuous surface of the spear (e.g., a helical channel or ridge, a screw thread or channel, a surface having an undulation that increases friction between the barb and the target.

A bumper may prevent penetration of an electrode into a target beyond a length of a spear. A bumper may prevent a body of an electrode from penetrating a target. A bumper may prevent a portion of an electrode body (e.g., forward portion, non-spear portion, face, etc.) from penetrating a target. A bumper may include an expandable portion configured to expand after launch. The expandable portion may be configured to expand prior to impact, during impact, or prior to and during impact. An expandable portion of a bumper may comprise one or more members. A bumper may comprise a rearward portion configured to couple the bumper to an electrode body. A rearward portion may be mechanically coupled to an electrode body via adhesives, interlocks, welds, press fits, overmolding, and any other suitable coupling method configured to attach a bumper to an electrode. In some embodiments, a bumper may be coupled to an electrode body by penetrating the bumper with the spear of the electrode body and inserting the spear through the bumper until the bumper abuts the electrode body. In some embodiments, a bumper may be coupled to an electrode body by overmolding the bumper over a forward surface of the electrode body. The forward surface of the electrode body coupled to the bumper may include a front surface and/or a forward side surface (e.g., an axially forward surface and/or a radially outer surface).

A bumper may prevent (or at least partially reduce) penetration of a spear into a target beyond a length of a spear. A bumper may prevent a length of a spear from fully penetrating a target. A bumper may be configured to couple to a spear. A bumper may be coupled to an end of a spear opposite a tip of the spear. A rearward portion of a bumper may be distal to a tip of a spear. A rearward portion of a bumper may be proximate the end of the spear that is opposite the tip of the spear. A bumper may be mechanically coupled to a spear via adhesives, interlocks, welds, press fits, and any other suitable coupling method configured to attach a bumper to a spear. A bumper may be overmolded to a spear. A spear may comprise one or more structures to facilitate adhesion of an overmolded bumper to the spear.

FIGS. 1A-2B show several views of an electrode 102 according to various embodiments disclosed herein. Electrode 102 may be configured to launch from a cartridge body 101 and toward a target to deliver a stimulus signal. Electrode 102 may comprise an electrode body 110, a spear 120, and a bumper 300. Electrode body 110 may longitudinally extend along an electrode axis 115 between a forward portion 112 (e.g., first portion) and a rearward portion 114 (e.g., second portion). Electrode body 110 may include a storage of filament 140. A length of filament 140 may be wound, coiled, or otherwise stored within electrode body 110. A spear 120 may extend from forward portion 112 of electrode body 110. Spear 120 may be integral with forward portion 112 (e.g., formed of the same material and/or formed at the same time). Spear 120 may be coupled to forward portion 112 via a press-fit, a crimp, adhesive, weld, or other any other joining method configured to couple spear 120 to forward portion 112. A terminus of forward portion 112 may comprise a face. A terminus of forward portion 112 may be defined by a plane perpendicular to electrode axis 115 that is coincident with forward portion 112, such as plane 116. Opposite forward portion 112, electrode body 110 may terminate in a rearward portion 114. Rearward portion 114 may include a surface configured to receive a propelling force provided by piston 160 and/or propulsion module 150 upon activation of propulsion module 150. Rearward portion 114 may comprise an opening to allow filament 140 to deploy from electrode body 102 as electrode 102 flies toward a target.

In various embodiments, bumper 300 may be disposed adjacent forward portion 112 of electrode 102. Bumper 300 may abut forward portion 112. Bumper 300 may overlap at least a part of forward portion 112. Bumper 300 may at least partially obstruct or overlap axial and/or radial outer surfaces of forward portion 112. Bumper 300 may surround (e.g., envelop, encircle, etc.) a portion of spear 120. For example, bumper 300 may comprise a thru hole, such as thru hole 312. Thru hole 312 may be concentric with electrode axis 115 of electrode 102. Thru hole 312 may be sized to receive spear 120. Spear 120 may extend through thru hole 312. Thru hole 312 may comprise a diameter that is less than a diameter of spear 120. In some embodiments, thru hole 312 may comprise a diameter that is equal to or greater than a diameter of spear 120.

In various embodiments, a mass of bumper 300 may be less than a cumulative mass of the other components of electrode 102 (e.g., electrode body 110, spear 120, filament 140, etc.). The mass of bumper 300 may be less than the cumulative mass of the other components of electrode 102 so as to not perturb the center of gravity and/or flight stability of electrode 102. For example, a mass of bumper 300 may account for less than 20% of the mass of electrode 102, less than 15% the mass of electrode 102, less than 10% the mass of electrode 102, and/or less than 5% of the mass of electrode 102.

Bumper 300 may be joined with forward portion 112 of electrode body 110. In some embodiments, thru hole 312 of bumper 300 may be sized to engage spear 120 via an interference fit (e.g., press fit). In some embodiments, bumper 300 may be overmolded on to forward portion 112 of electrode body 110. In some embodiments, bumper 300 may be assembled with electrode 102 prior to assembly of electrode 102 with cartridge 100. In some embodiments, bumper 300 may be assembled with electrode 102 after assembly of electrode 102 with cartridge 100.

In various embodiments, bumper 300 may overlap a portion, or all of, a length of spear 120. For example, bumper 300 may overlap a portion of the length of the spear, such that the resulting exposed length L0 (i.e., depth) of spear 120 is greater than zero. A distance between forward end 301 of bumper 300 and tip 127 of spear 120 may be greater than zero. As another example, bumper 300 may overlap all of spear 120, such that exposed length L0 is zero. In embodiments, exposed length L0 is equal to the depth of spear 120 that may penetrate a target, prior to contact of bumper 300 with the target. Bumper 300 may impact a target at depths greater than L0.

Figure 3A:
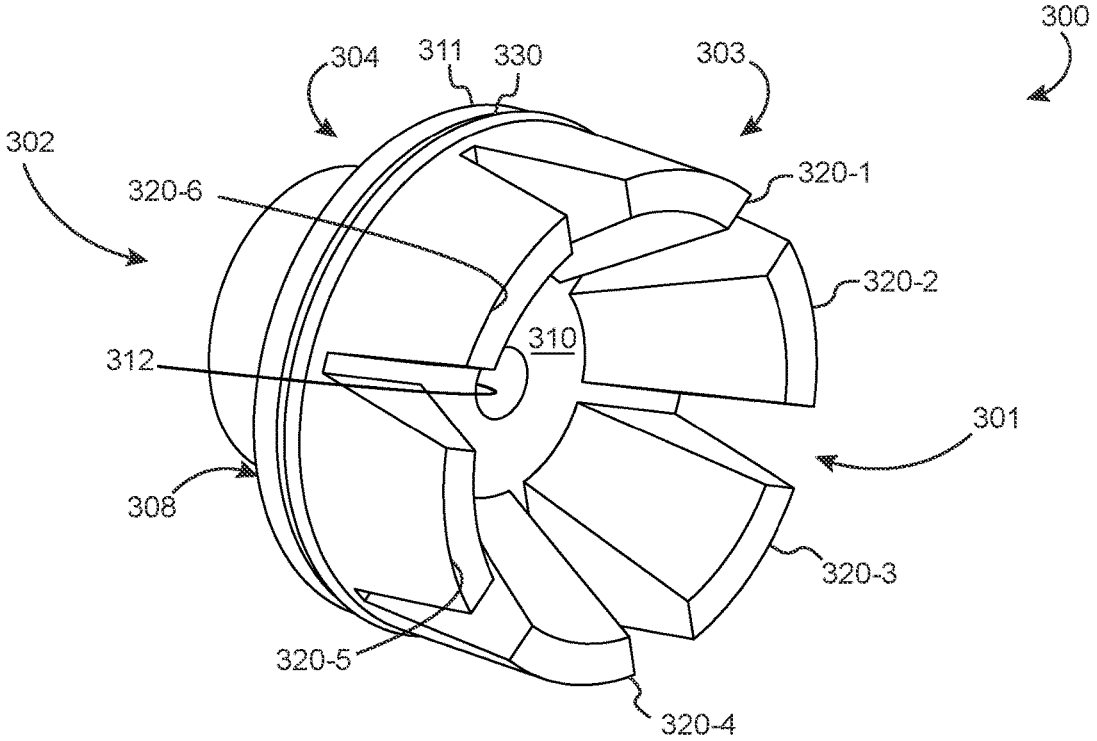
FIG. 3A is a front perspective view showing an implementation of a bumper, according to various aspects of the present disclosure.
Figure 3B:
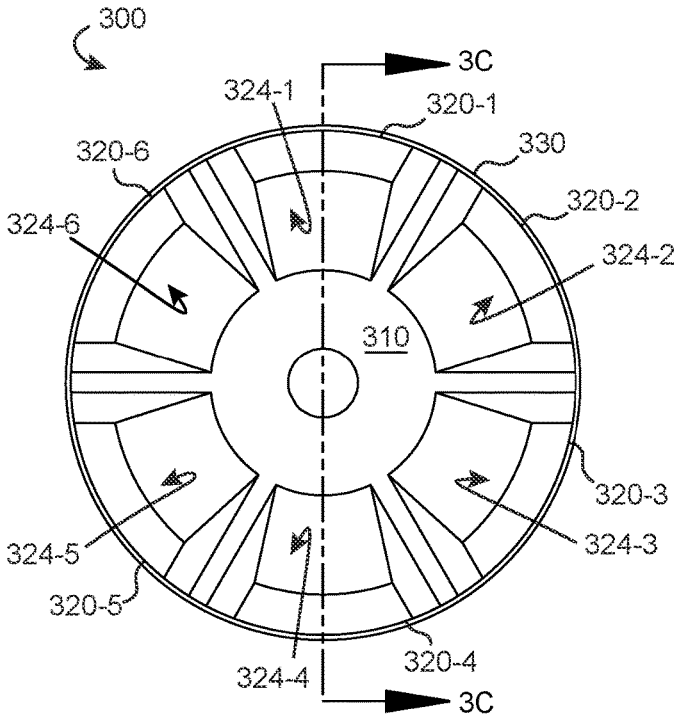
FIG. 3B is a front view showing the bumper of FIG. 3A, according to various aspects of the present disclosure.
Figure 3C:
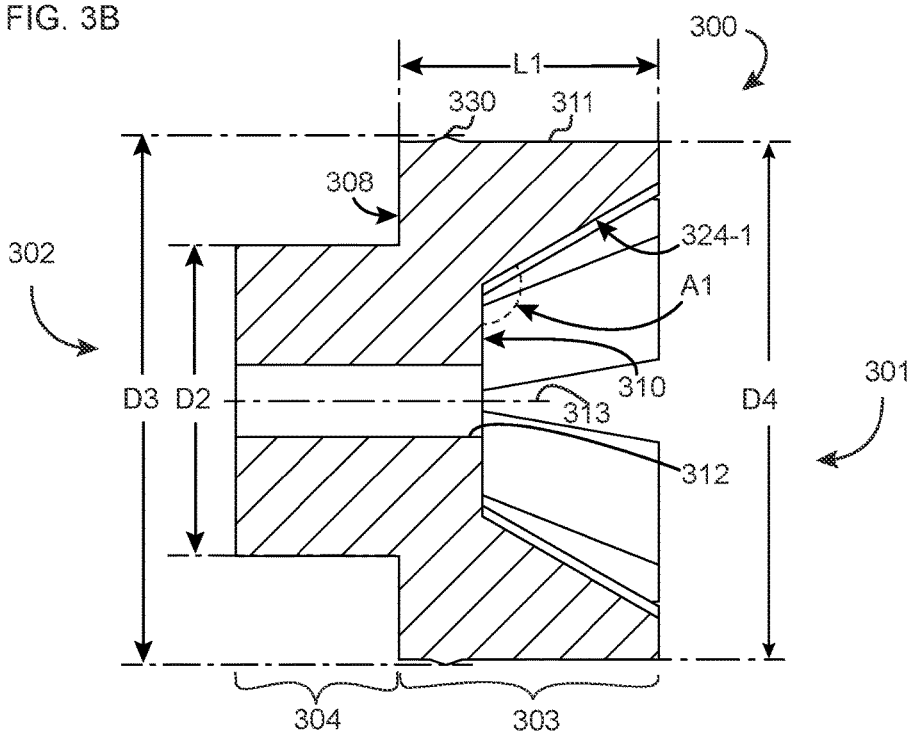
FIG. 3C is a cross section view of the bumper of FIG. 3B along plane 3C-3C, according to various aspects of the present disclosure.

Bumper 300 may comprise a rearward portion (e.g., first portion, coupling portion, joining portion, attachment portion, etc.), such as rearward portion 304 (with brief reference to FIGS. 3A and 3C). Rearward portion 304 may be configured to couple bumper 300 to forward portion 112 of electrode body 110. Rearward portion 304 may be sized and/or shaped to interface with forward portion 112. For example, rearward portion 304 may be sized and shaped to press-fit into forward portion 112. In other embodiments, rearward portion 304 may be sized and shaped couple over an axially forward surface of forward portion 112 and/or a radially outer surface of forward portion 112. Rearward portion 304 may include an outer diameter D2 configured to engage a respective diameter of forward portion 112 via an interference fit. Rearward portion 304 may overlap a portion of forward portion 112. Forward portion 112 may receive rearward portion 304, rearward portion 304 may receive forward portion 112, or rearward portion 304 and forward portion 112 may each receive one another (i.e., rearward portion 304 and forward portion 112 may comprise multiple overlapping and/or interlocking structures). As another example, bumper 300 may be integral with (e.g., formed of the same material, formed at the same, and/or overmolded over) forward portion 112. Forward portion 112 may comprise thru-holes, dimples, surface texting, or other interlocking features configured to improve strength of coupling between bumper 300 and forward portion 112. A person of ordinary skill in the art will appreciate that adhesives, welds, fasteners, and other coupling methods may be employed to secure bumper 300 to forward portion 112.

A bumper, according to various aspects of the present disclosure, may perform one or more of the following functions in any combination: prevent (or at least partially reduce) penetration (e.g., puncture) of an electrode body into a target; minimize blunt impact of an electrode body with tissue; and/or provide a circumferential seal between an electrode and a cartridge body prior to launch. A bumper may prevent (or at least partially reduce) penetration of the bumper into a target, minimize blunt impact of the bumper with tissue, provide a circumferential seal between an electrode and a cartridge body prior to launch, or combinations thereof. Preventing penetration and/or minimizing blunt impact of the electrode body and/or bumper into tissue may be achieved by an increase in contact area of the bumper prior to, or during impact, and/or absorption of impact energy via expansion of the bumper (e.g., extending a duration of a collision between the bumper and the target).

FIGS. 3A-3B show several views of bumper 300 at rest (e.g., in an unexpanded state, undeformed state, collapsed state, contracted state, relaxed state, etc.), in accordance with various embodiments disclosed herein. In various embodiments, one or more portions of bumper 300 may be formed of a deformable (e.g., flexible, etc.) material. Upon impact with a target, the deformable material may be configured to elastically (e.g., temporarily, etc.) deform, or plastically (e.g., permanently, etc.) deform. The deformable material may include thermoplastic vulcanizates (e.g., SANTOPRENE), silicone rubbers, polyurethanes, polybutadienes, and other materials configured to deform upon impact with a target after being launched from a launch device. The deformable material may include resilient materials (e.g., materials having high yield strengths and low moduli of elasticity, materials exhibiting spring-like properties, etc.). The deformable material may include elastomeric materials. The deformable material may include soft materials. For example, a hardness of the deformable material may be between Shore 30 A and Shore 50 A, between Shore 50 A and shore 70 A, between Shore 70 A and Shore 100 A, between Shore 50 A and Shore 100 A, or any other hardness configured to enable expandable portion 303 to deform upon impact with a target.

In various embodiments, bumper 300 may comprise a unitary body (e.g., formed of a single continuous part). In some embodiments, bumper 300 may comprise multiple parts. Bumper 300 may comprise a shape corresponding with a shape of an electrode body, a shape of a forward portion of an electrode (e.g., forward portion 112, with brief reference to FIG. 2B), and/or a shape of a cartridge (e.g., cartridge body 101). For example, bumper 300 may have a substantially cylindrical shape, conical shape, prolate shape (e.g., elongated sphere, etc.), or frustoconical shape (e.g., truncated cone, etc.). The shape of bumper 300 may include rotational symmetry about an axis (e.g., rotational axis, axis of rotation, etc.), such as axis 313. The shape of bumper 300 may comprise mirror symmetry. The shape of bumper 300 may comprise aerodynamic features to stabilize flight of electrode 102 and/or reduce drag of electrode 102 as electrode 102 flies toward a target.

In various embodiments, bumper 300 may include a first end 301 (e.g., forward end, impact end, etc.) and a second end 302 (e.g., rearward end, adjoining end, attachment end, etc.) opposite first end 301. Bumper 300 may comprise a thru hole, such as thru hole 312, that extends from second end 302 to a base surface 310 (e.g., base, etc.). Bumper 300 may comprise multiple portions. The multiple portions may extend longitudinally between first end 301 and second end 302 along axis 313. For example, bumper 300 may comprise a first portion adjacent a second portion. The first portion may directly abut (e.g., coincide with) the second portion. The first portion may be configured to attach to (e.g., couple with) a forward portion of an electrode body, such as forward portion 112. The second portion may be configured to expand to accomplish the functions of a bumper as described herein.

In various embodiments, bumper 300 may comprise an expandable portion 303, (e.g., forward portion, first portion, deformable portion, etc.) and a rearward portion 304 (e.g., attachment portion, second portion, joining portion, etc.). Expandable portion 303 may extend from first end 301. Rearward portion 304 may extend from second end 302. Rearward portion 304 may extend axially forward second end 302. Rearward portion 304 and expandable portion 303 may be contiguous. Rearward portion 304 may adjoin (e.g., coincide with, etc.) expandable portion 303 at a distance L1 from first end 301. When bumper 300 is assembled with electrode body 110, rearward portion 304 may overlap part of forward portion 112 and expandable portion 303 may be disjoint (e.g., not overlap) a part of forward portion 112. In various embodiments, bumper 300 may comprise a surface, such as surface 308 that is configured to abut forward portion 112 of electrode 102. Surface 308 may be configured to be flush with a forward portion 112. Surface 308 may be configured to transfer a force of impact on expandable portion 303 directly to electrode body 110 via forward portion 112. Expandable portion 303 may be directly coupled to forward portion 112 independent of a manner in which rearward portion 304 is mechanically coupled to expandable portion 303.

In various embodiments, rearward portion 304 may comprise a shape configured to engage forward portion 112. The shape of rearward portion 304 may complement a shape of forward portion 112. Rearward portion 304 may be configured to sit flush with forward portion 112. Rearward portion 304 may comprise a cylindrical shape configured to overlap a respective cylindrical shape of forward portion 112. For example, rearward portion 304 may comprise a cylinder having a diameter D2. Diameter D2 may be sized to engage forward portion 112. As an example, diameter D2 may be between 0.025 inches and 0.050 inches (0.635 millimeters and 1.270 millimeters), between 0.050 inches and 0.750 inches (1.270 millimeters and 1.905 millimeters), between 0.075 inches and 0.100 inches (1.905 millimeters and 2.540 millimeters), between 0.025 inches and 0.100 inches (0.635 millimeters and 2.540 millimeters), or any other suitable size greater than a diameter of spear 120.

In various embodiments, expandable portion 303 may be configured to expand upon impact with a target to increase a contact area between electrode 102 and the target and/or absorb a portion of the impact force imparted on the target by electrode 102. Prior to impact, expandable portion 303 may include an outer surface 311 sized and/or shaped to be received by a bore of cartridge body 101. The size and/or shape of outer surface 311 may be selected to fit within cartridge body 101 prior to launch of electrode 102 from cartridge 100. In embodiments, and in a collapsed state of bumper 300, outer surface 311 may be disposed parallel axis 313.

Outer surface 311 may be consistent or vary in diameter over distance L1. A maximum diameter of outer surface 311 in a collapsed state is collapsed diameter D4. In some embodiments, collapsed diameter D4 may be less than exit diameter D1 to minimize frictional losses imparted by the bore of cartridge body 101 on bumper 300 as electrode 102 is launched from cartridge 100. In some embodiments, collapsed diameter D4 may be equal exit diameter D1.

In various embodiments, expandable portion 303 may include a protrusion configured to provide a seal between the bore of cartridge body 101 and/or to provide a frictional force to resist movement of electrode 102 relative to cartridge body 101 prior to launch. For example, expandable portion 303 may include protrusion 330. Protrusion 330 may extend radially outward from outer surface 311 and encircle a portion of, or all of, outer surface 311. Protrusion 330 may be disposed along axis 313 of bumper 300 proximate a location at which expandable portion 303 adjoins rearward portion 304. In embodiments, protrusion 330 may be positioned proximate a midpoint of bumper 300 along axis 313. In embodiments, protrusion 330 may be positioned closer to rearward portion 304 than to first end 301 along axis 313. A maximum diameter of protrusion 330 may be a maximum diameter D3. Maximum diameter D3 may be slightly greater than exit diameter D1 of cartridge body 101 to provide an interference fit between bumper 300 and the bore of cartridge body 101. For example, maximum diameter D3 may be 0.001 inches (0.0254 millimeters) greater than exit diameter D1, 0.002 inches (0.0508 millimeters) greater than exit diameter D1, 0.003 inches (0.0762 millimeters) greater than exit diameter D1, or any other diameter suitable for providing a seal and/or frictional force to resist movement of electrode 102, while minimally affecting accuracy and/or trajectory of electrode 102. In embodiments, collapsed diameter D4 may be less than maximum diameter D3.

In various embodiments, expandable portion 303 may comprise one or more members. For example, expandable portion 303 may include members (e.g., expandable members, deformable members, etc.) such as members 320 (e.g., deformable structures, first member 320-1, second member 320-2, third member 320-3, fourth member 320-4, fifth member 320-5, sixth member 320-6, etc.). The members may encircle (e.g., be arranged in a circular pattern about, etc.) axis 313 of bumper 300 (e.g., thru hole 312). The members may be arranged at regularly spaced intervals about axis 313, such as every 30 degrees, every 60 degrees, every 90 degrees, and/or the like. In embodiments, portion 303 of bumper 300 may include an order of rotational symmetry equal to a quantity of the plurality of members. For example, an order of rotational symmetry of bumper 300 may be six in accordance with a quantity of six members 320-1-320-6 as illustrated in FIG. 3A. In embodiments, a quantity of members may be at least three and/or less than eight.

Each member may include an arc measure corresponding with the angle of the sector it occupies on base surface 310. For example, an arc measure of each member may be between 30 and 40 degrees, between 40 and 50 degrees, between 50 and 60 degrees, between 60 and 70 degrees, or any other suitable measure configured to enable each member to adjust radially outward upon impact with a target. Each member may expand in differing outward radial directions upon impact.

In various embodiments, a channel (e.g., slot, void, etc.) may separate adjacent members. Each member may be separated from an adjacent member by a channel. An arc measure of the channel may greater than, equal to, or less than an arc measure of the member. In various embodiments, the arc measure of each channel may be less than the arc measure of each member. For example, an arc measure of the channel may be between 0 degrees and 2 degrees, between 2 degrees and 5 degrees, between 5 degrees and 10 degrees, or between any other suitable measure configured to enable each member to deform radially outward upon impact with a target. A shape of the channel may comprise a V-shape, a U-shape, and/or any other suitable or desired shape. An arc measure of a channel may decrease in a direction from first end 301 toward second end 302 along axis 313. A width of a channel between adjacent members may be greater at first end 301 than a width of the channel between the adjacent members at base surface 310. In embodiments, a V-shaped channel may result in increased stiffness of each of the adjacent members in a direction toward base surface 310, thereby encouraging each of the adjacent members to flex radially outward from axis 313 upon impact. The shape of the channel may be defined in a circumferential direction about axis 313. In embodiments, bumper 300 may comprise a plurality of channels, wherein each member of a plurality of members is separated from an adjacent member of the plurality of members by a respective channel of the plurality of channels. At least one channel of a plurality of channels of a bumper may be disposed between pair of adjacent members of a plurality of members of the expandable portion of the bumper.

Each member may extend between impact end 301 and rearward portion 304 of bumper 300. In embodiments, one or more members may protrude (e.g., project, extend, stick out, etc.) from a surface of an expandable portion of a bumper. For example, each member of members 320 may project from base surface 310 of bumper 300. Each member of members 320 may protrude in a same direction. Each member of members 320 may extend in a direction toward a forward end 301 of bumper 300.

In various embodiments, a shape of each member of members 320 may include a tapered shape that decreases in size between base surface 310 and first end 301. The tapered shape may result in an increased stiffness toward base surface 310 and a decreased stiffness toward first end 301. A mass of expandable portion 303 may decreases in a direction away from rearward end 302 of bumper 300 and toward forward end 301 of bumper 300. The mass may decrease in accordance with the tapered shape. The tapered shape may be provided coplanar with axis 313 as illustrated in FIG. 3C.

In various embodiments, the arrangement and shape of the members in combination with the arrangement and shape of the channels may generally comprise a castellated nut (i.e., castle nut, etc.) shape or a slotted inverted (e.g., reversed) frustoconical cup shape. The tapered shape may be provided between surfaces of the member comprising at least one face or surface that is not non-parallel to a base surface 310 and non-parallel with axis 313. Each face of the members that is non-parallel to base surface 310 and non-coincident with outer surface 311 may comprise a positive draft relative to base surface 310. The shape of each of the members may flare between base surface 310 and first end 301. The shape of each of the members may comprise a truncated right triangle shape. The truncated right triangle shape may be revolved along an arc. The shape of each of the members may comprise a wedge shape. The shape of each of the members may be configured to encourage each of the members to adjust (e.g., adjust, deform, etc.) radially outward during impact with a target. In some embodiments, a forward end of each member may terminate in an edge. The edge may be defined along an intersection of an outer surface and a non-parallel surface of a member. In other embodiments, the forward end of each member may terminate in a face. The face may be provided between an outer surface and a non-parallel surface of a member. In embodiments, the face may be disposed perpendicular to axis 313 in a collapsed state of bumper 300.

In various embodiments, each member of the one or more members 320 may coincide with outer surface 311 of expandable portion 303. A perimeter of the one or more members may lie on outer surface 311. The perimeter of the one or more of members may comprise a diameter.

In various embodiments, one or more members 320 may include one or more engagement surfaces 324. Each member of members 320 may include respective engagement surface of engagement surfaces 324 (e.g., first engagement surface 324-1, second engagement surface 324-2, third engagement surface 324-3, fourth engagement surface 324-4, fifth engagement surface 324-5, sixth engagement surface 324-6, etc.). Each engagement surface may extend between base surface 310 and first end 301. Each engagement surface may intersect base surface 310. Each engagement surface may be non-parallel and/or non-perpendicular with base surface 310. Each engagement surface may comprise a face or surface that is non-parallel with a portion of outer surface 311 by which the respective member is defined. In various embodiments, each engagement surface may be generally flat or incurvate. At impact with a target, a portion of each engagement surface may contact the target. The cumulative area of the surfaces of electrode 102 in contact with the target during impact (e.g., portions of engagement surfaces 324) may be referred to as the contact area (e.g., impact area, area of impact, etc.). As a bumper impacts a target, the portion of each engagement surface may be sized and/or shaped to encourage each of the respective members to deform outward, thereby further increasing the impact area over the duration of impact.

FIG. 3C shows a cross sectional view of bumper 300 of FIG. 3B along plane 3C-3C, which coincides with a mirror plane of symmetry of one or more members 320 (e.g., first member 320-1). At rest (e.g., in an undeformed or collapsed state, etc.), an engagement surface of engagement surfaces 324 (e.g., first engagement surface 324-1) may form an angle, such as relaxed angle A1, with base surface 310. Relaxed angle A1 may include an oblique angle. Relaxed angle A1 may be selected to optimize the function of bumper 300 as described herein. For example, relaxed angle A1 may be obtuse (e.g., greater than ninety degrees) so as to encourage each of members 320 to deform outward from axis 313, upon impact with a target, thereby increasing the impact area. For example, relaxed angle A1 may be between 115 degrees and 130 degrees, between 130 degrees and 145 degrees, between 145 degrees and 160 degrees, between 115 degrees and 160 degrees, or any other suitable angle greater than 90 degrees. A larger relaxed angle A1 may improve the ability of bumper 300 to perform the functions discussed herein at non-perpendicular (e.g., oblique) impact angles with a target.

Figure 4A:
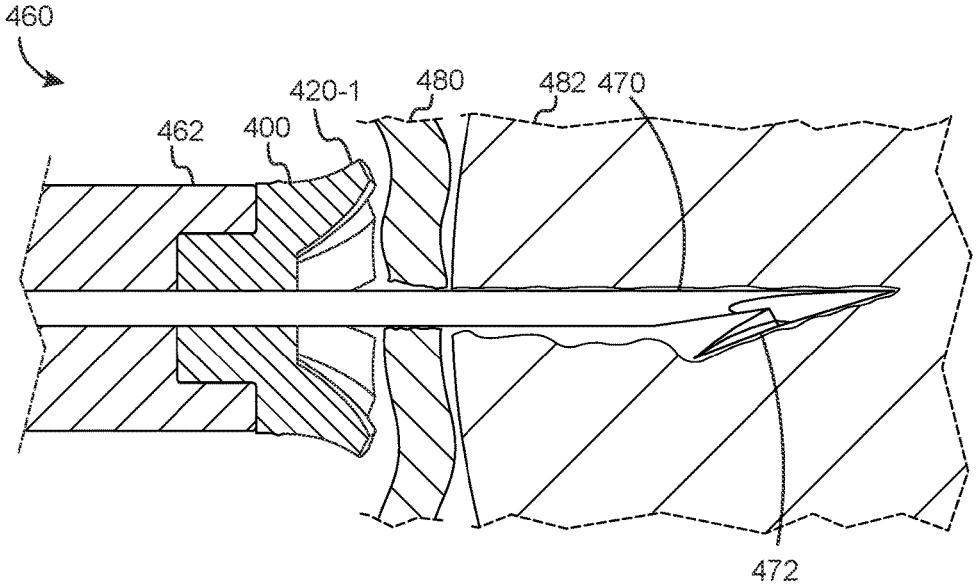
FIG. 4A is a section view of the electrode of FIG. 2A taken along plane 2B-2B after impact with a target, according to various aspects of the present disclosure.

FIG. 4A shows a cross section of an electrode 460 along plane 2B-2B impacting a target after being launched from a launch device, such as launch device 10. Electrode 460 may be similar to, or share similar aspects or components with, the electrodes discussed previously herein (e.g., electrode 102, etc.). In the example of FIG. 4A, spear 470 has penetrated both article of wear 480 (e.g., clothing, armor, etc.) and tissue 482 of the target. Barb 472 has lodged in tissue 482 to resist mechanical decoupling of electrode 460 and tissue 482. In the example of FIG. 4A, bumper 400 is shown engaged with the target in an expanded state (e.g., deformed state, etc.).

Figure 4B:
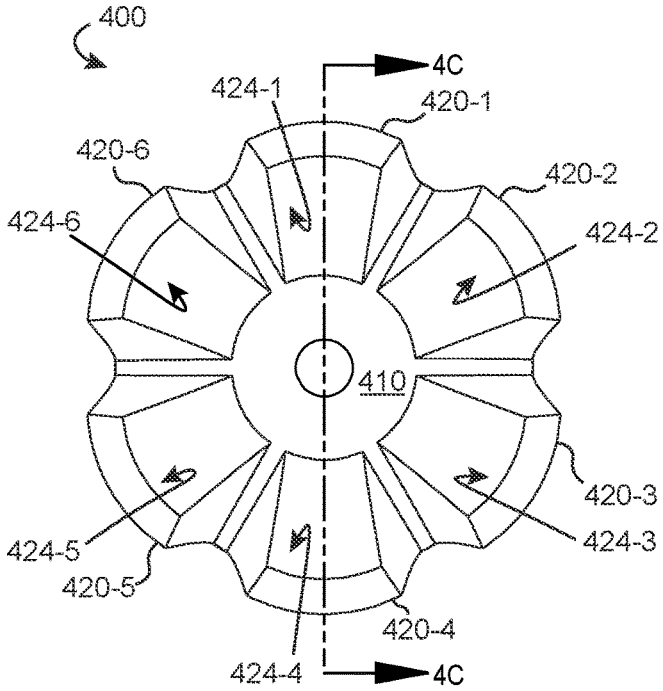
FIG. 4B is a front view showing an implementation of a bumper after impact with a target, according to various aspects of the present disclosure.
Figure 4C:
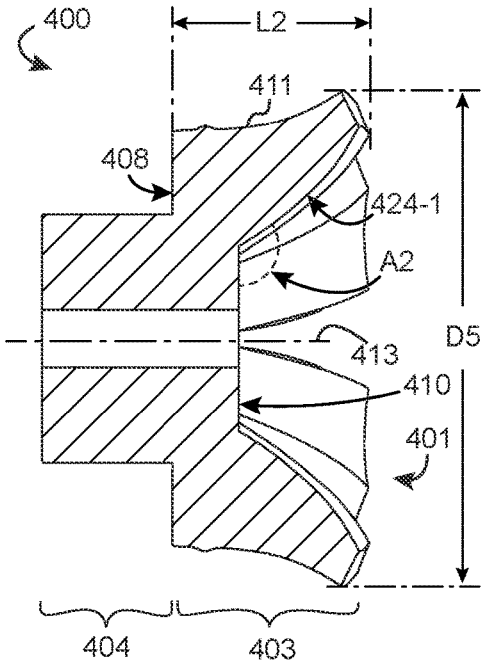
FIG. 4C is a cross section view of the bumper of FIG. 4B taken along plane 4C-4C, according to various aspects of the present disclosure.

In various embodiments, a bumper may transition from a first state to a second state. The first state may comprise a first physical state and the second state may comprise a second physical state. The second state may be different from the first state. One or more of a relative position, orientation, and dimension of a same element or feature of the bumper may differ between the first state and the second state. For example, and in accordance with various aspects of the present disclosure, bumper 400 of FIGS. 4A-4C show a bumper, such as bumper 400 in an expanded (e.g., deformed) state (e.g., during impact, post impact, etc.), whereas FIGS. 3A-3C depict bumper 300 in a collapsed (e.g., relaxed, contracted, etc.) state (e.g., prior to impact, etc.). In embodiments, bumper 400 may correspond to bumper 300 in an expanded state. Bumper 400 may comprise bumper 300 after transition of bumper 300 from a collapsed state to an expanded state. Bumper 300 may correspond to bumper 400 in a collapsed state. One or more elements or features of bumper 400 may correspond to one or more elements of bumper 300. For the bumpers illustrated in FIGS. 4A-4C, corresponding elements or features are referred to using similar reference numerals under the "4xx" series of reference numerals, rather than the "3xx" as used in the embodiments of FIGS. 3A-3C.

As an electrode flies toward a target, momentum of the electrode causes the spear of the electrode to pierce the target until exposed length L0 (with brief reference to FIG. 2B) is embedded in the target. Typically, however, the momentum of the electrode is not exhausted by penetration of the spear to a depth L0 in the target. At this point, and according to various aspects of the present disclosure, the remaining momentum of the electrode is transferred to the target via impact of the bumper with the target. The bumper is configured to reduce the impact force in response to the change in momentum, thereby preventing penetration of at least a portion of the electrode (e.g., forward portion, electrode body, etc.) into the target. The bumper may expand (e.g., deform), thereby extending the impact time of the bumper with the target, which in turn reduces the impact force. As the bumper expands, the impact area may increase (e.g., by members flaring outward from axis 413), thereby distributing the force of impact over a greater area, which in turn may prevent the electrode body from penetrating the target. Both increasing the impact area while extending the impact time may have a synergistic effect on reducing blunt impact and preventing penetration of tissue of a target by the electrode body.

In various embodiments, a bumper may transition (e.g., deform, expand, transform, etc.) from a collapsed state to an expanded state during impact with a target. For example, bumper 300, shown in a collapsed state, may transition to an expanded state (e.g., as shown in bumper 400), during impact with the target.

The expanded state of bumper 400 may provide a greater contact area between electrode 460 and the target. One or more members 420 (e.g., first member 420-1, second member 420-2, third member 420-3, fourth member 420-4, fifth member 420-5, sixth member 420-6, etc.) may expand away from axis 413 as electrode 460 impacts the target, thereby increasing the contact area of bumper 400. For example, the contact area of bumper 400 may be greater than the contact area of bumper 300 by 50%, 100%, 150%, 200%, or other percentage configured to prevent a forward portion of the electrode from penetrating the target. In embodiments, the contact area of bumper 400 may increase by at least 20% in an expanded state. The force of impact imparted by electrode 460 may be distributed over the greater contact area, thereby reducing the stress imparted on tissue 482. Reducing the stress imparted on tissue 482 may prevent the forward portion of electrode 460 (e.g., bumper 400, forward portion 462 of electrode 460, etc.) from penetrating tissue 482. Reducing the stress imparted on tissue 482 may minimize blunt force applied to tissue 482.

Once spear 470 penetrates tissue 482 to a depth equal to exposed length L0 (with brief reference to FIG. 2B), a portion of the remaining kinetic energy of electrode 460 may be absorbed by expansion of members 420 of bumper 400, thereby reducing the impact force of electrode 460 on tissue 482. Reducing the impact force of electrode 460 on tissue 482 may in turn prevent forward portion 462 of electrode 460 from penetrating tissue 482 and/or minimize blunt force impact on tissue 482.

At impact, one or more members 420 (e.g., first member 420-1, second member 420-2, third member 420-3, fourth member 420-4, fifth member 420-5, sixth member 420-6, etc.) may compress, such that distance L2 may be less than distance L1 of bumper 300. Distance L2 associated with a length of expandable portion 403 of bumper 400 along axis 413 may be less than distance L1 associated with a length of expandable portion 303 of bumper 300 along axis 313. At impact, one or more members 420 may deform outward away from axis 413, thereby increasing an outer diameter D5 of expandable portion 403, such that outer diameter D5 may be greater than outer diameter D4 of bumper 300. Outer diameter D5 of deformed bumper 400 may be greater than exit diameter D1 of a cartridge body, such as cartridge body 101. In this manner, a bumper having a greater impact area than would typically be feasible for a cartridge 100 may be assembled into a cartridge 100. In embodiments, a first diameter of expandable portion 403 may be greater proximate forward end 401 of bumper 400 than a second diameter of expandable portion 403 along axis 413 away from forward end 401. For example, a diameter of bumper 400 at forward end 401 along axis 413 may be greater than a diameter of bumper 400 at one or more of base surface 410 and surface 408 between expandable portion 403 and rearward portion 404. In embodiments, diameters at corresponding locations along axis 313 of bumper 300 may be equal.

In various embodiments, at least one surface of a bumper may be altered in an expanded state. For example, outer surface 411 may be non-parallel with axis 413. In contrast, outer surface 311 may be disposed parallel to axis 413. Alternately or additionally, an angle of at least one engagement surface of engagement surfaces 424 (e.g., first engagement surface 424-1, second engagement surface 424-2, third engagement surface 424-3, fourth engagement surface 424-4, fifth engagement surface 425-5, sixth engagement surface 424-6, etc.) may change. For example, angle A2 between an engagement surface of engagement surfaces 424 may increase for bumper 400 in an expanded state. Alternately or additionally, a shape at least one member of members 420 may be modified. For example, a shape of member 420-1 may comprise an obtuse triangle shape along plane 4C-4C as illustrated in FIG. 4C, whereas a shape of member 320-1 may comprise a right triangle shape along plane 3C-3C as illustrated in FIG. 3C.

In various embodiments, a bumper may comprise a hard deformable material. For example, a hard deformable material may comprise high-density polypropylene (HDPE), polycarbonate/acrylonitrile butadiene styrene (PC/ABS), aluminum, and titanium, whereas a deformable material may comprise materials such as elastomers, rubbers, or those having low Shore hardnesses as previously discussed herein.

Figure 5A:
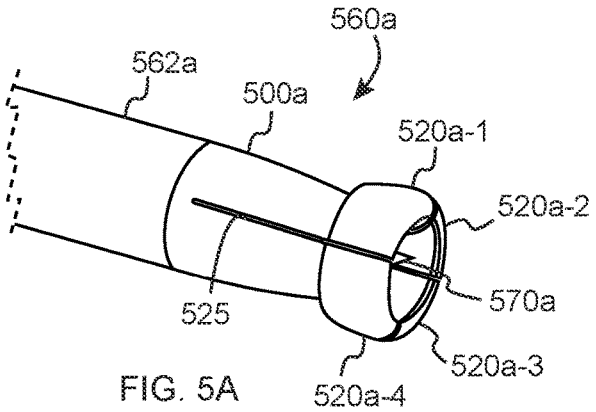
FIG. 5A is a front perspective view of an implementation of an electrode prior to launch, according to various aspects of the present disclosure.
Figure 5B:
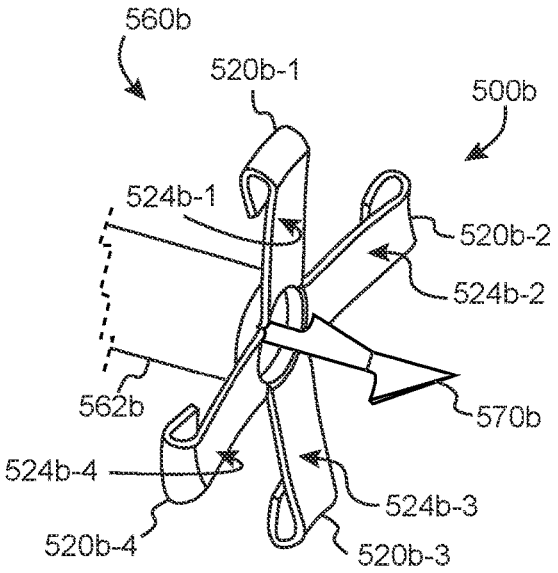
FIG. 5B is a front perspective view of the electrode of FIG. 5A after launch, according to various aspects of the present disclosure.

FIGS. 5A-5B show a broken view of an electrode 560*a* and electrode 560*b* in accordance with various embodiments described herein. Electrodes 560*a/b* comprise an electrode body 562*a/b*, a spear 570*a/b*, and a bumper 500*a/b*. Bumper 500*a/b* may be similar to, or share similar aspects or components with, one or more bumpers discussed previously herein (e.g., bumper 300, 400, etc.). In the example of FIG. 5A, bumper 500*a* is in a collapsed state (e.g., relaxed state, at rest, non-deformed, etc.). Bumper 500*a* may form a sheath around a portion of, or all of spear 570*a*. In various embodiments, a forward end of bumper 500*a* may cover at least 50% of spear 570*a*, at least 75% of spear 570*a*, or 100% of spear 570*a*. Bumper 500*a* may protect spear 570*a* from damage or protect personnel from injury while handling electrodes (e.g., during manufacturing, reloading, etc.).

Bumper 500*a* may comprise a hard deformable material as previously discussed herein. Bumper 500*a* may comprise a rearward portion configured to attach bumper 500*a* to a forward portion of electrode body 562*a*. An expandable portion may extend from the rearward portion and terminate at the forward end of bumper 500*a*. The expandable portion may increase in mass and/or thickness toward the forward end of bumper 500*a* to increase a stiffness of the forward end of bumper 500*a*. A shape of the expandable portion toward the forward end of bumper 500*a* may flare outward to encourage the expandable portion to deform upon impact with a target.

The expandable portion may include a plurality of members, such as first member 520*a*-1, second member 520*a*-2, third member 520*a*-3, fourth member 520*a*-4, etc. Each member of the plurality of members may be connected to an adjacent member by a respective frangible portion, such as frangible portion 525.

In various embodiments, a frangible portion of one or more frangible portions 525 may connect two adjacent members. The frangible portion may comprise a thickness that is less than a thickness of each of the two adjacent members. The frangible portion may comprise a series of perforations (e.g., cutouts), configured to encourage the expandable portion to break apart along the frangible portions upon impact with a target.

In the example of FIG. 5B, bumper 500*b* of electrode 560*b* is shown in an expanded state (e.g., after or during impact with a target). A force of impact of the electrode with the target may cause the frangible portions 525 (with brief reference to FIG. 5A) to break apart (e.g., rupture, tear, etc.), thereby allowing each member of the members to flex outward and away from spear 570*b*. Upon impact, the shape of each member toward the forward end of bumper 500*b* may direct a portion of the impact force outwards to encourage the frangible portions 525 to rupture, thereby enabling the bumper to expand from a collapsed state (e.g., collapsed bumper 500*a*) to an expanded state (e.g., expanded bumper 500*b*).

A bumper comprising frangible portions is an example of a passive bumper, wherein a passive bumper transitions from a collapsed state to an expanded state responsive to impact with a target. A passive bumper may be formed of a non-compressible material. A passive bumper may function to increase the impact area of the expandable portion of the bumper during impact with a target in response to the force of impact. An impact area of a passive bumper may be dynamic, as the impact area may increase over the impact duration.

In the expanded state, the impact area of bumper 500*b* may be significantly increased compared with an impact area of a similar electrode without a bumper. Engagement surfaces, such as first engagement surface 524*b*-1, second engagement surface 524*b*-2, third engagement surface 524*b*-3, and fourth engagement surface 524*b*-4 may be exposed upon impact of the electrode with the target, and subsequent rupture of the perforations adjoining adjacent members. The cumulative impact area provided by the plurality of engagement surfaces may minimize blunt force and/or prevent penetration of at least a portion of the electrode into the target as previously discussed herein.

Figure 6A:
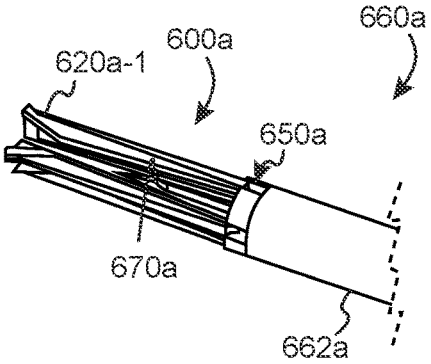
FIG. 6A is a front perspective view of an implementation of an electrode prior to launch, according to various aspects of the present disclosure.
Figure 6B:
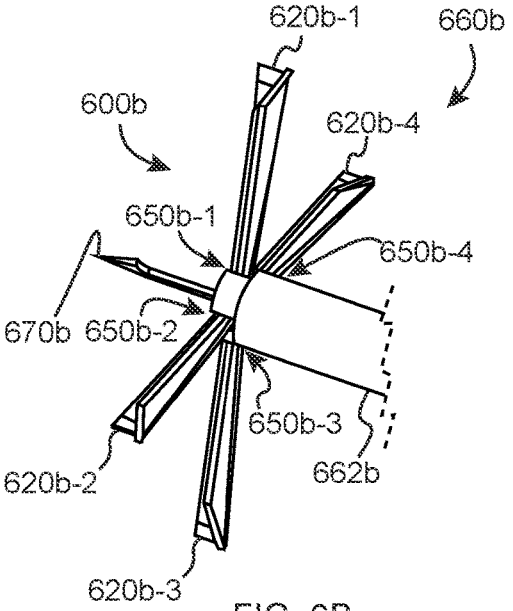
FIG. 6B is a front perspective view of the electrode of FIG. 6A after launch, according to various aspects of the present disclosure.

FIGS. 6A-6B show a broken view of an electrode 660*a* and electrode 660*b* in accordance with various embodiments described herein. Electrodes 660*a/b* comprise an electrode body 662*a/b*, a spear 670*a/b*, and a bumper 600*a/b*. Bumper 600*a/b* may be similar to, or share similar aspects or components with, one or more bumpers discussed previously herein (e.g., bumper 300, 400, 500*a/b* etc.). In the example of FIG. 6A, bumper 600*a* is in a collapsed state (e.g., relaxed state, at rest, non-deformed, etc.). Bumper 600*a* may form a sheath around a portion of, or all of spear 670*a*. Bumper 600*a* may protect spear 670*a* from damage and/or protect personnel from injury while handling electrodes (e.g., during manufacturing, reloading, etc.).

Bumper 600*a* may comprise a hard deformable material as previously discussed herein. Bumper 600*a* may comprise a rearward portion configured to attach bumper 600*a* to a forward portion of electrode body 662*a*. An expandable portion may extend from the rearward portion and terminate at the forward end of bumper 600*a*.

The expandable portion may include a plurality of members. For example, the expandable portion may comprise first member 620*a*-1, second member 620*a*-2, third member 620*a*-3, and fourth member 620*a*-4. Each member of the plurality of members may be connected to the rearward portion by a hinge, such as hinge 650*a*.

In various embodiments, a hinge may connect (e.g., attach) a member to a rearward portion of a bumper. The hinge may be configured to movably couple a member to a rearward portion of a bumper. The hinge may comprise a thickness that is less than or equal to a thickness of adjacent material and is configured to flex (e.g., a living hinge). The hinge may comprise a joint allowing one degree of rotation, such as a pin joint (e.g., revolute joint). A hinge may function in conjunction with a biasing device (e.g., spring, etc.) that is configured to bias a member into an expanded state about the hinge. In various embodiments, a biasing device may encourage a member to expand to an expanded state prior to impact with a target about a hinge. A biasing device may aid in biasing a member away from a spear.

A bumper comprising a biasing device configured to bias a member about a hinge is an example of an active bumper, wherein an active bumper actively transitions from a collapsed state to an expanded state prior to impact with a target. An active bumper may be formed of a non-compressible material. An active bumper may function to actively increase the impact area of the expandable portion of the bumper prior to impact with a target. Responsive to exiting the bore of a cartridge, an active bumper may transition from the collapsed state to the expanded state. One or more springs may encourage the expandable portion of the bumper to expand after launch and prior to impact with a target. An impact area of an active bumper may be substantially constant during impact.

A hinge may enable each respective member to expand outward from a collapsed state to an expanded state. The hinge may enable the member to expand prior to impact with a target or during impact with the target. A hinge may enable a member to rotate about an axis perpendicular to an axis of the bumper. A hinge may be configured to encourage the expandable portion to expand about the hinge prior to and/or during impact with a target.

In the example of FIG. 6B, bumper 600*b* of electrode 660*b* is shown in an expanded state (e.g., after or during impact with a target). Each member of the members (e.g., first member 620*b*-1, second member 620*b*-2, third member 620*b*-3, fourth member 620*b*-4, etc.) is rotated outward and substantially perpendicular to spear 670*b*. One or more portions of electrode body 662*b* may serve as a mechanical stop (e.g., limit) to prevent each member 620*b* from rotating beyond a position perpendicular to spear 670*b*. A force of impact of the electrode with the target may cause each member of the members to rotate outward and away from spear 670*b*.

In various embodiments, one or more biasing devices may be configured impart a force on members 620*a/b* to cause members 620*a/b* to expand upon exiting a cartridge body (e.g., cartridge body 101). While stored in a cartridge body, an inner surface of the bore of the cartridge body may prevent the members from being biased outward. After launch, once electrode 660*a* has exited the bore of the cartridge body, each biasing device may act on a respective member 620*a* to transition bumper 660*a* from a collapsed state to an expanded state, prior to impact with a target. In the expanded state, the impact area of bumper 600*b* may be significantly increased compared with an impact area of a similar electrode without a bumper, thereby minimizing risk of injury.

Figure 7:
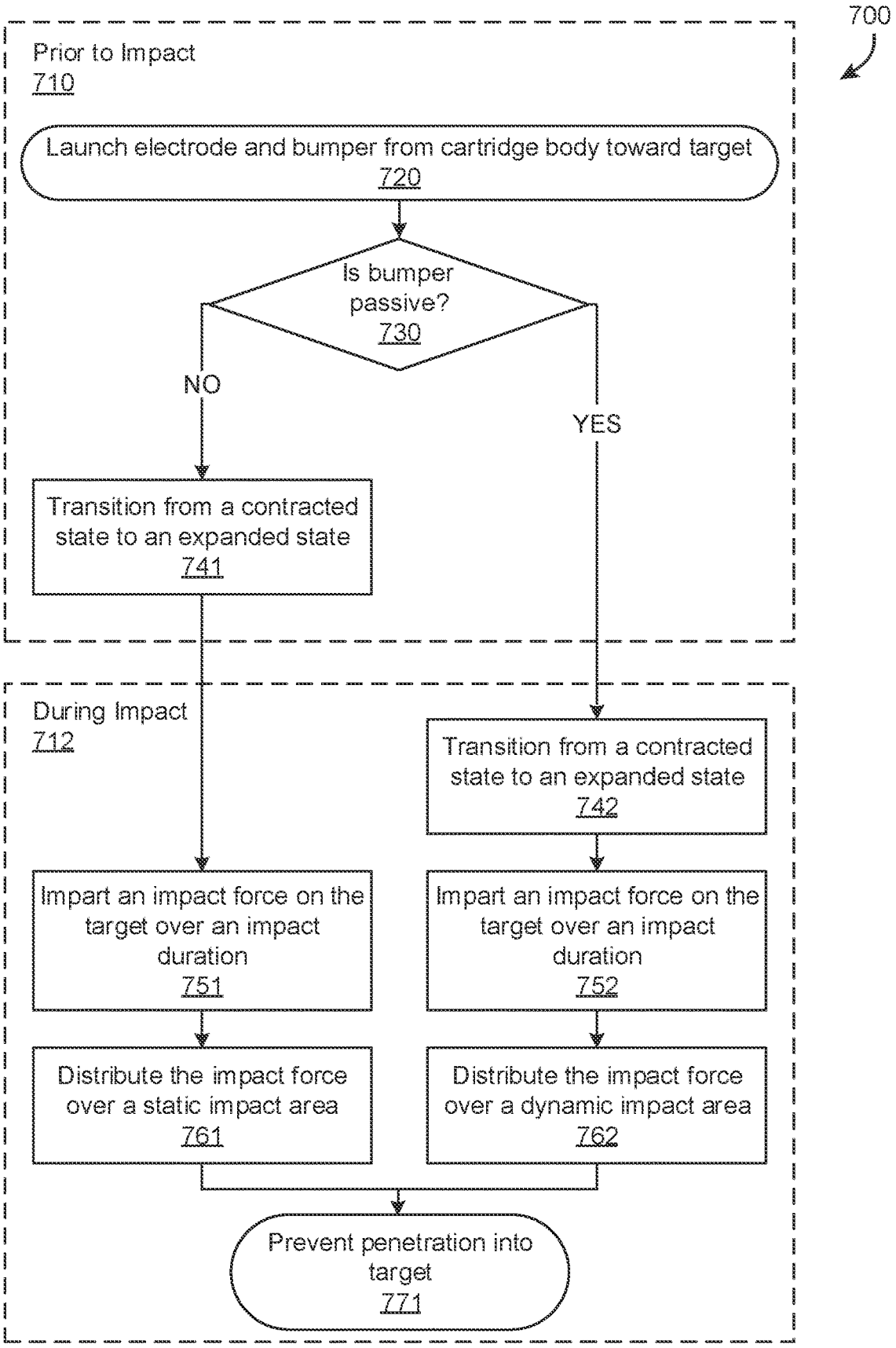
FIG. 7 is a block flow diagram of a method of distributing a force of impact, according to various aspects of the present disclosure.

Various aspects of the current disclosure include methods for distributing an impact force performed by a bumper. For example, FIG. 7 shows an example block diagram of method 700. In embodiments, a first portion 710 of the method may occur, prior to impact. A second portion 712 of method 700 may occur during impact. Each of first portion 710 and second portion 712 may comprise one or more operations performed by the bumper. First portion 710 may be performed by the bumper in a collapsed state. Second portion 712 may be performed by the bumper in an expanded state. The bumper may remain in the collapsed state during first portion 710. In accordance with one or more operations of second portion 712, or prior to one or more operations of second portion 712, the bumper may transition (e.g., physically transform) to the expanded state.

Prior to impact, a first portion 710 of method 700 may comprise providing a bumper. The bumper may be included with an electrode, such as electrode 102 with brief reference to FIG. 1B. The bumper may mechanically couple to an electrode body of the electrode. In embodiments, the bumper may be disposed in a cartridge. The bumper may comprise bumper 300, 500*a*, or 600*a*, with brief reference to FIGS. 3A-3C, 5A, and 6A.

Upon receipt of an activation, the electrode and bumper may launch 720 from the cartridge body toward a target. For example, an operation of a user control of a launch device may send an activation signal to the cartridge to activate a propulsion module, thereby launching the electrode and bumper from the cartridge.

In various embodiments, the bumper may be passive or active as discussed previously herein. At decision 730, if the bumper is active, the bumper may transition 741 from the collapsed state to the expanded state prior to impact and continue flying toward the target until impacting the target. The bumper may transition 741 to the expanded state prior to performing the one or more operations of second portion 712.

Alternatively, if the bumper is passive, the bumper may continue to fly toward the target in the collapsed state until impacting the target. The bumper may remain in the collapsed state until the one or more operations associated with second portion 712 during impact are performed.

Within second portion 712 during impact, the active bumper may impart an impact force over an impact duration 751. The bumper may impart the impact force in accordance with physical contact between the bumper and the target. As the active bumper may have previously transitioned 741 from the collapsed state to the expanded state during first portion 710 prior to impact, the impact force may be distributed 761 over a static (e.g., constant, unchanging, etc.) impact area. In accordance with the impact force distributed 761 over a static impact area, the bumper may prevent 771 penetration of at least a portion of the electrode into the target.

Within second portion 712 during impact, the passive bumper may impart 752 an impact force on the target over an impact duration. In accordance with second portion 712 during impact, the passive bumper the passive bumper may transition 742 from the collapsed state to the expanded state. As the passive bumper transitions between states, the impact area may dynamically change, and the impact force may therefore be distributed 762 over a dynamic impact area. In accordance with the impact force distributed 761 over a static impact area, the bumper may prevent 771 penetration of at least a portion of the electrode into the target.

Aspects of this disclosure relate to an electrode. In a first example embodiment, an electrode may comprise an electrode body, where the electrode body extends along an axis between a first portion and a second portion opposite the first portion; the electrode may comprise a spear that extends from the first portion of the electrode body and in a direction away from the second portion of the electrode body, where the spear terminates in a tip; and the electrode may comprise a bumper that extends from a rearward end to a forward end, where the rearward end of the bumper is adjacent the first portion of the electrode body, and where the bumper includes an expandable portion configured to transition from a collapsed state to an expanded state after launch of the electrode to prevent the forward portion of the electrode body from penetrating a provided target.

In a second example embodiment of an electrode, the bumper may comprise a rearward portion adjacent the expandable portion, where the rearward portion is configured to couple the rearward end of the bumper to the first portion of the electrode body.

A third example embodiment of an electrode may include an electrode of any one of the preceding example embodiments, where a mass of the expandable portion of the bumper decreases in a direction away from the rearward end of the bumper and toward the forward end of the bumper.

A fourth example embodiment of an electrode may include an electrode of any one of the preceding example embodiments, where a length between the forward end of the bumper and the tip of the spear is greater than zero inches.

A fifth example embodiment of an electrode may include an electrode of any one of the preceding example embodiments, where the bumper comprises a radial protrusion that has a first diameter greater than a second diameter of the electrode body.

A sixth example embodiment of an electrode may include an electrode of any one of the preceding example embodiments, where the expandable portion of the bumper comprises a plurality of members.

A seventh example embodiment of an electrode may include an electrode of any one of the preceding example embodiments, where the expandable portion of the bumper includes an order of rotational symmetry equal to a quantity of the plurality of members.

An eighth example embodiment of an electrode may include an electrode of any one of the preceding example embodiments, where the expandable portion of the bumper is configured to transition from the collapsed state to the expanded state in response to impact with the provided target.

A ninth example embodiment of an electrode may include an electrode of any one of the preceding example embodiments, where the transition from the collapsed state to the expanded state is configured to increase a duration of the impact with the target, thereby reducing a force of impact on the provided target to prevent the first portion of the electrode body from penetrating the provided target.

Another aspect of this disclosure relates to a bumper for an electrode. In a first example embodiment of a bumper for a provided electrode, the bumper may comprise a rearward portion that is configured to couple to the provided electrode; and an expandable portion adjacent the rearward portion, where: after launch, the expandable portion is configured to transition from a collapsed state to an expanded state to prevent at least a portion of the provided electrode from penetrating a provided target.

A second example embodiment of a bumper may include a bumper of any one of the preceding example embodiments, where the expandable portion comprises a plurality of members arranged in a circular pattern about an axis.

A third example embodiment of a bumper may include a bumper of any one of the preceding example embodiments, where a shape of the expandable portion comprises a castellated nut shape.

A fourth example embodiment of a bumper may include a bumper of any one of the preceding example embodiments, where a first impact area of the expanded state of the expandable portion is greater than a second impact area of the collapsed state of the expandable portion; and the first impact area of the expanded state of the expandable portion is configured to distribute a force of impact on the target to prevent at least the portion of the provided electrode from penetrating the provided target.

A fifth example embodiment of a bumper may include a bumper of any one of the preceding example embodiments, where the expandable portion is configured to transition from the collapsed state to the expanded state in response to the bumper impacting the provided target.

A sixth example embodiment of a bumper may include a bumper of any one of the preceding example embodiments, where the transition from the collapsed state to the expanded state is configured to increase a duration of impact to prevent at least the portion of the provided electrode from penetrating the provided target.

A seventh example embodiment of a bumper may include a bumper of any one of the preceding example embodiments, where the rearward portion and the expandable portion comprise a unitary body.

An eighth example embodiment of a bumper may include a bumper of any one of the preceding example embodiments, where the unitary body comprises an elastomeric material.

A ninth example embodiment of a bumper may include a bumper of any one of the preceding example embodiments, where each member of the plurality of members comprises an engagement surface configured to engage the provided target upon impact, and wherein each engagement surface forms an oblique angle with a base surface of the bumper.

A tenth example embodiment of a bumper may include a bumper of any one of the preceding example embodiments, where a shape of each member of the plurality of members is tapered and decreases in size in a direction away from the rearward portion.

An eleventh example embodiment of a bumper may include a bumper of any one of the preceding example embodiments, where a number of members of the plurality of members is greater than or equal to four.

A twelfth example embodiment of a bumper may include a bumper of any one of the preceding example embodiments, further comprising a plurality of channels, wherein each member of the plurality of members is separated from an adjacent member of the plurality of members by a respective channel of the plurality of channels.

A thirteenth example embodiment of a bumper may include a bumper of any one of the preceding example embodiments, where each channel of the plurality of channels comprises a V-shape.

A fourteenth example embodiment of a bumper may include a bumper of any one of the preceding example embodiments, where each member of the plurality of members comprises a first arc measure, and wherein each channel comprises a second arc measure that is less than the first arc measure.

Another aspect of this disclosure relates to a method performed by a bumper. In a first example embodiment of a method performed by a bumper, the method may comprise receiving an electrode of a conducted electrical weapon at a rearward end of the bumper; launching from the conducted electrical weapon; and transitioning an expandable portion of the bumper from a collapsed state to an expanded state after the launching to distribute the force of impact.

A second example embodiment of a method performed by a bumper may include the method of any one of the preceding example embodiments, further comprising imparting the force of impact over an impact duration.

A third example embodiment of a method performed by a bumper may include the method of any one of the preceding example embodiments, further comprising distributing the force of impact over an impact area, where the impact area is greater in the expanded state than the impact area in the collapsed state; and preventing penetration of a forward portion of the electrode into a provided target.

A fourth example embodiment of a method performed by a bumper may include the method of any one of the preceding example embodiments, where the transitioning occurs in response to imparting the force of impact.

A fifth example embodiment of a method performed by a bumper may include the method of any one of the preceding example embodiments, where the expandable portion comprises providing a first member having a first impact end opposite the rearward end; and transitioning the expandable portion from the collapsed state to the expanded state comprises adjusting the first member of the expandable portion in a first outward radial direction.

A sixth example embodiment of a method performed by a bumper may include the method of any one of the preceding example embodiments, where transitioning from the collapsed state to the expanded state comprises providing a second member having a second impact end opposite the rearward end; and transitioning the expandable portion from the collapsed state to the expanded state comprises adjusting the second member of the expandable portion in a second outward radial direction different from the first outward radial direction.

A seventh example embodiment of a method performed by a bumper may include the method of any one of the preceding example embodiments, where the transitioning comprises increasing the impact duration, and preventing penetration into the target is attributed to at least one of distributing the force of impact over the impact area in the expanded state and increasing the impact duration.

The foregoing description discusses preferred embodiments of the present invention, which may be changed or modified without departing from the scope of the present invention as defined in the claims. Examples listed in parentheses may be used in the alternative or in any practical combination. As used in the specification and claims, the words 'comprising', 'comprises', 'including', 'includes', 'having', and 'has' introduce an open-ended statement of component structures and/or functions. In the specification and claims, the words 'a' and 'an' are used as indefinite articles meaning 'one or more'. While for the sake of clarity of description, several specific embodiments of the invention have been described, the scope of the invention is intended to be measured by the claims as set forth below. In the claims, the term "provided" is used to definitively identify an object that not a claimed element of the invention but an object that performs the function of a workpiece that cooperates with the claimed invention. For example, in the claim "an apparatus for aiming a provided barrel, the apparatus comprising: a housing, the barrel positioned in the housing", the barrel is not a claimed element of the apparatus, but an object that cooperates with the "housing" of the "apparatus" by being positioned in the "housing". A person of ordinary skill in the art will appreciate that this disclosure includes any practical combination of the structures and methods disclosed. While for the sake of clarity of description several specifics embodiments of the invention have been described, the scope of the invention is intended to be measured by the claims as set forth below. No claim element is intended to invoke 35 U.S.C. 112(f) unless the element is expressly recited using the phrase "means for."

Where a phrase similar to "at least one of A, B, or C" is used in the claims, it is intended that the phrase be interpreted to mean that A alone may be present in an embodiment, B alone may be present in an embodiment, C alone may be present in an embodiment, or that any combination of the elements A, B and C may be present in a single embodiment; for example, A and B, A and C, B and C, or A and B and C.

The words "herein", "hereunder", "above", "below", and other word that refer to a location, whether specific or general, in the specification shall refer to any location in the specification.

What is claimed is:

1. An electrode comprising:

an electrode body, wherein the electrode body extends along an axis between a first portion and a second portion opposite the first portion;

a spear that extends from the first portion of the electrode body and in a direction away from the second portion of the electrode body, wherein the spear terminates in a tip; and a bumper that extends from a rearward end to a forward end, wherein the rearward end of the bumper is adjacent the first portion of the electrode body, wherein the forward end of the bumper defines an expandable portion axially forward the rearward end, wherein the expandable portion is configured to transition from a collapsed state to an expanded state after launch of the electrode, and wherein in the expanded state the expandable portion is configured to deform radially outward.

2. The electrode of claim 1, wherein the bumper comprises a rearward portion adjacent the expandable portion, and wherein the rearward portion is configured to couple the rearward end of the bumper to the first portion of the electrode body.

3. The electrode of claim 1, wherein a mass of the expandable portion of the bumper decreases from the rearward end of the bumper to the forward end of the bumper.

4. The electrode of claim 1, wherein a length between the forward end of the bumper and the tip of the spear is greater than zero inches.

5. The electrode of claim 1, wherein the expandable portion of the bumper comprises a plurality of members.

6. The electrode of claim 5, wherein the expandable portion of the bumper includes an order of rotational symmetry equal to a quantity of the plurality of members.

7. The electrode of claim 1, wherein the expandable portion is configured to transition from the collapsed state to the expanded state in response to an impact of the bumper with a target.

8. A bumper for a provided electrode comprising:

a rearward portion configured to couple to the provided electrode; and an expandable portion forward the rearward portion, wherein in response to the bumper impacting a target the expandable portion is configured to deform radially outward.

9. The bumper of claim 8, wherein a shape of the expandable portion comprises a castellated nut shape.

10. The bumper of claim 8, wherein:

the expandable portion is configured to deform radially outward by transitioning from a collapsed state to an expanded state, and a first impact area of the expanded state is greater than a second impact area of the collapsed state.

11. The bumper of claim 8, wherein the expandable portion comprises a plurality of members arranged in a circular pattern about an axis.

12. The bumper of claim 11, wherein each member of the plurality of members comprises an engagement surface configured to engage the target upon impact, and wherein each engagement surface forms an oblique angle with a base surface of the bumper.

13. The bumper of claim 11, wherein a shape of each member of the plurality of members is tapered and decreases in size in a direction away from the rearward portion.

14. The bumper of claim 11, further comprising a plurality of channels, wherein each member of the plurality of members is separated from an adjacent member of the plurality of members by a respective channel of the plurality of channels.

15. The bumper of claim 14, wherein each channel of the plurality of channels comprises a V-shape.

16. The bumper of claim 14, wherein each member of the plurality of members comprises a first arc measure, and wherein each channel of the plurality of channels comprises a second arc measure that is less than the first arc measure.

17. A method performed by a bumper for distributing a force of impact, the method comprising:

receiving an electrode of a conducted electrical weapon at a rearward end of the bumper wherein the bumper comprises an expandable portion defined on a forward end axially forward the rearward end of the bumper;

launching from the conducted electrical weapon; and transitioning the expandable portion of the bumper from a collapsed state to an expanded state after the launching to distribute the force of impact, wherein in the expanded state the expandable portion is deformed radially outward.

18. The method of claim 17, further comprising distributing the force of impact over an impact area, wherein the impact area is greater in the expanded state than the impact area in the collapsed state.

19. The method of claim 17, wherein the expandable portion comprises a first member having a first impact end opposite the rearward end, and transitioning the expandable portion from the collapsed state to the expanded state comprises adjusting the first member of the expandable portion in a first outward radial direction.

20. The method of claim 19 , wherein the expandable portion comprises a second member having a second impact end opposite the rearward end, and transitioning the expandable portion from the collapsed state to the expanded state comprises adjusting the second member of the expandable portion in a second outward radial direction different from the first outward radial direction.

* * * * *